United States Patent [19]

Miyata

[11] Patent Number: 5,028,751

[45] Date of Patent: Jul. 2, 1991

[54] LEAF SWITCH

[75] Inventor: Muneyoshi Miyata, Tokyo, Japan

[73] Assignee: Mitsuku Denshi Kogyo Kabushiki Kaisha, Tokyo, Japan

[21] Appl. No.: 512,518

[22] Filed: Apr. 19, 1990

Related U.S. Application Data

[63] Continuation of Ser. No. 273,913, Nov. 21, 1988, abandoned.

[51] Int. Cl.[5] ..... H01H 1/30

[52] U.S. Cl. ..... 200/283

[58] Field of Search ..... 200/283

[56] References Cited

U.S. PATENT DOCUMENTS 3,823,280 7/1974 Obermann et al. ..... 200/283 X
4,196,328 4/1980 Ishikawa ..... 200/283 X
4,453,058 6/1984 Miyata ..... 200/283
4,587,389 5/1986 Willigman ..... 200/283 X

*Primary Examiner*—Renee S. Luebke
*Attorney, Agent, or Firm*—Oblon, Spivak, McClelland, Maier & Neustadt

[57] ABSTRACT

A leaf switch which includes a plurality of contact leaf springs (2*a*, 2*b*) embedded in an insulating base (1). The contact leaf springs (2*a*, 2*b*) are each held at a setting point ($P_1$, $P_2$) while being kept in a stressed state by being forcedly inflected by a bracket (4) of an inverted U-shape pivotally mounted on the insulating base (1). The bracket (4) bends the contact leaf springs (2*a*, 2*b*) when it is pivotally moved and is coupled to the insulating base when it is pivotally moved to its end point, thereby defining the setting point for each contact leaf spring.

8 Claims, 6 Drawing Sheets

LEAF SWITCH

This application is a continuation of application Ser. No. 273,913, filed on Nov. 21, 1988, now abandoned.

BACKGROUND OF THE INVENTION

The present invention relates to a leaf switch.

In a conventional leaf switch, a plurality of contact leaf springs are embedded in an insulating base by insert molding when the insulating base is formed by plastics molding. Unfortunately, insert molding fails to provide a leaf switch with high dimensional accuracy. Furthermore, small-sized leaf switches re now being produced. For example, a leaf switch in accordance with the present invention might practically be formed with dimensions of about 16 mm×8 mm×8 mm.

In view of the foregoing, conventional leaf switch designs encounter the following problems: a leaf switch of the normally open type, in which the contacts are normally separated from one another, would tend not to have the contact leaf springs properly positioned at accurate intervals, so that the intervals between the leaf contacts would be non-uniform from switch to switch. A leaf switch of the normally-closed type, in which the contacts are normally in contact with one another, would tend not to have the contact between the contacts under uniform or constant pressure.

The above described problems lead to a failure in equalization of the force required to inflect or bend the contact leaf springs in a switching operation. This results in the switching operation failing to result in contact between the contacts under uniform contact pressure or force. Furthermore, these contact leaf springs are readily deformed by an external shock or the like. This deformation increases the above-described problems.

Fine and accurate adjustment of the leaf switch to eliminate the above problems are highly troublesome and require much time and labor.

Thus, conventional leaf switches fail to exhibit a fine and accurate switching action over a long period of time. Also, conventional leaf switches are not suitable for mass production because mass production methods fail to provide the conventional leaf switch with uniform characteristics, and tend to affect adversely the performance of the device in which the leaf switch is used.

SUMMARY OF THE INVENTION

Accordingly, it is an object of the present invention to provide a leaf switch which is capable of keeping the intervals between contacts uniform or constant and with high accuracy.

It is another object of the present invention to provide a leaf switch which is capable of rendering the operation force required for its switching operation highly uniform or constant.

It is a further object of the present invention to provide a leaf switch which is free of adverse effects from external shocks or the like.

It is yet another object of the present invention to provide a leaf switch which is capable of exhibiting a satisfactory performance constantly and accurately.

It is still a further object of the present invention to provide a leaf switch which is suitable for mass-production.

According to the invention, there is provided a leaf switch comprising a plurality of contact leaf springs embedded in and protruding from an insulating base, the leaf springs extending substantially parallel with one another and each having a contact; the leaf springs each being forcedly inflected to maintain them in a stressed state by holding at least one leaf spring at a setting point, thereby providing either a predetermined or uniform interval between the contacts on the leaf springs, or a predetermined or uniform pressure for pressed contact between the contacts, whereby the operating power required for contact and/or separation between contacts is rendered uniform.

The switch preferably includes a setting member movably mounted with respect to the base between a first position in which it inflects the leaf springs into their stressed states and a second position in which it does not inflect the leaf springs effectively. Preferably, the setting member is a bracket of an inverted U-shape pivotally mounted on the base and including a top plate and two side plates, the bracket inflecting the contact leaf springs when it is pivotally moved and being coupled to the base when it is pivotally moved to its first position Conveniently, the distal ends of the top plate and side plates of the bracket define setting points for the contact leaf springs when the bracket is moved to its first position, resulting in each contact leaf spring being held in a stressed state at its own setting point.

One embodiment of the invention comprises a leaf switch of the normally-closed type including two leaf springs, one of the leaf springs being held at a setting point and bending the other leaf spring whereby, in this condition, both leaf springs are in a stressed state.

Another embodiment of the invention comprises a leaf switch of the normally-open type including two leaf springs each of which is engaged by the setting member in its first position to hold both leaf springs at a setting point and in a stressed state.

Yet another embodiment of the invention comprises a leaf switch of the composite type including three leaf springs, two being normally closed and two being normally open, the two normally open leaf springs each being engaged by the setting member in its first position to hold each at a setting point, the third leaf spring being bent by one of the normally open leaf springs whereby all three leaf springs are in a stressed state.

Preferably, the switch further comprises a hollow cover pivotally mounted on the insulating base in a manner to cover the contact leaf springs and the setting member. The hollow cover may provide on its inner surface engaging portions which are arranged to engage engaging portions on the leaf springs.

As can be seen from the foregoing, in the leaf switch of the present invention, each of the contact leaf springs is kept in a stressed state at the setting point by forced inflection. Such a construction permits the intervals between the contacts to be kept uniform or constant with a high degree of accuracy, renders operating force required for its switching operation highly uniform or constant, and eliminates the need for any adjustment of spacing between the leaf contacts or adjustment of the elastic force of the leaf contacts. It is also free of any adverse effects from external shocks and constantly exhibits a satisfactory performance with high accuracy Thus, switches in accordance with the invention are very suitable for mass-production.

Thus, since in the present invention a bracket of inverted U-Shape may be pivotally mounted on the insulating base, so that pivotal movement of the so-mounted bracket to the end point may cause each of the contact leaf springs to be automatically bent or inflected and kept in a stressed state at the setting point, the structure of the leaf switch can be highly simplified.

Furthermore, the present invention may include a hollow cover pivotally mounted on the insulating base. Such a constructions permits actuation of the engaging portions to operate the switch by external operation of the hollow cover only. Also, the hollow cover protects the contact lead springs and bracket, which constitute the essential parts of the switch, from the external environment, thereby effectively preventing them from being exposed to external shocks, dust and the like.

BRIEF DESCRIPTION OF THE DRAWINGS

The present invention may be carried into practice in various ways and some embodiments will now be described by way of example with reference to the accompanying drawings, in which:

FIG. 3(*c*) is a front elevation view of the leaf switch of FIGS. 3(*a*) and 3(*b*) after pivotal mounting of the bracket thereon;

DETAILED DESCRIPTION OF THE PREFERRED EMBODIMENTS

Figure 1:
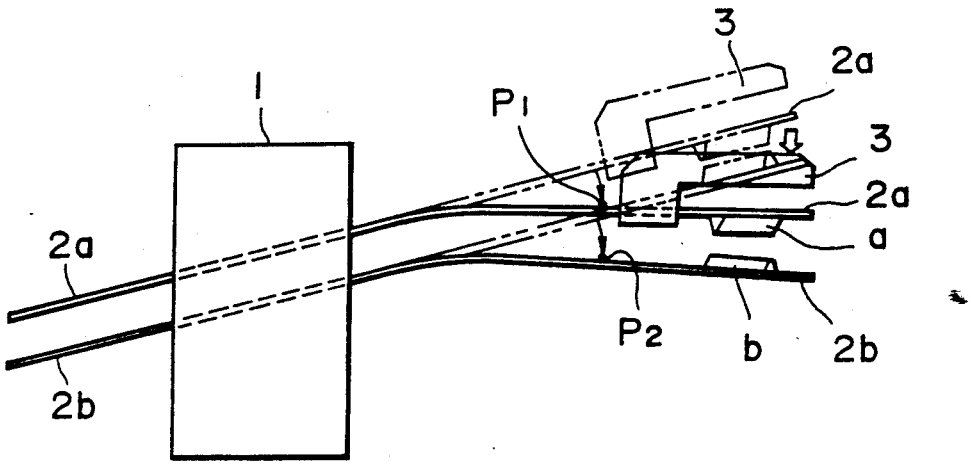
FIG. 1 is a schematic view showing a leaf switch of the normally-closed type as one embodiment of the present invention.
Figure 2:
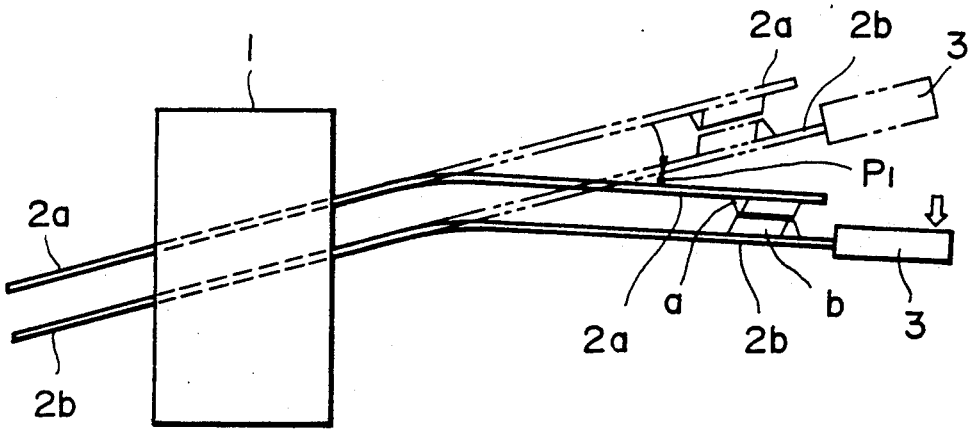
FIG. 2 is a schematic view showing a leaf switch of the normally-closed type as another embodiment of the present invention.

FIGS. 1 and 2 each show an embodiment of a leaf switch according to the present invention, which includes an insulating base 1, and contact leaf springs 2*a* and 2*b* embedded in and protruding from the insulating base 1. The leaf springs 2*a* and 2*b* include contacts a and b respectively and operating elements 3 on the leaf spring. $P_1$ and $P_2$ each designate a setting point.

The leaf switch shown in FIG. 1 is a normally-open type, in which the leaf springs 2*a* and 2*b* are forcedly inflected or bent to cause the contacts a and b to be held in a power storing or stressed state at the setting points $P_1$ and $P_2$, respectively.

The leaf switch shown in FIG. 2 is a normally-closed type in which the contact leaf spring 2*a* is forcedly bent by pressure at the setting point $P_1$ to press the contacts a and b into contact with each other, resulting in the contact leaf spring 2*b* then being bent and kept in a stressed state.

In the normally-open leaf switch of FIG. 1, when the operating element 3 in its stressed state at the setting point $P_1$ is pressed, the contact leaf spring 2*a* is bent, causing the contact a of the contact leaf spring 2*a* to be contacted with the contact b of the contact leaf spring 2*b* (also in its stressed state at the setting point $P_2$) resulting in the switch being turned on. Release of the operating element 3 causes the contacts a and b to separate, leading to the switch being turned off.

In the normally-closed leaf switch of FIG. 2, the contact a of the contact leaf spring 2*a* held bent and kept in a stressed state at the setting point $P_1$, is pressed into contact with the contact b of the contact leaf spring 2*b*, so that the contact leaf spring 2*b* is bent, resulting in its also being kept in a stressed state. Accordingly, pressing the operating element 3 bends the contact leaf spring 2*b* and breaks the contact between the contacts and a and b, thereby leading to the switch being turned off. Release of the operating element 3 returns the contact leaf spring 2*b* to its original position in which the contacts a and b are in contact, resulting in the switch being turned on.

Figure 3B:
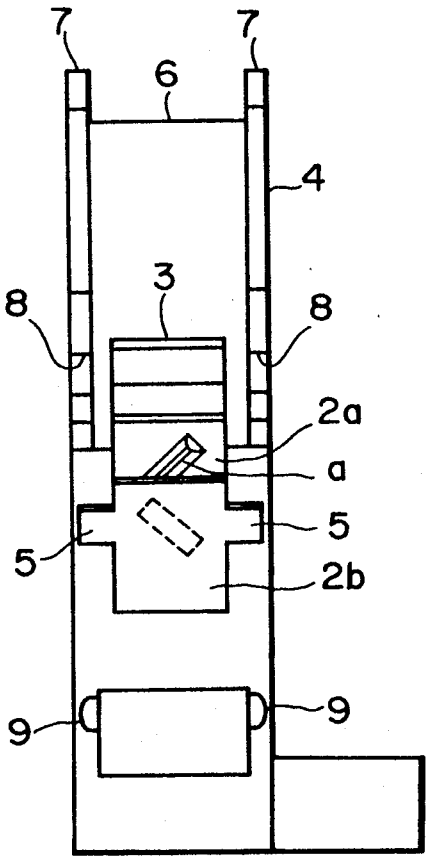
FIGS. 3(*a*) to 3(*c*) show a further embodiment of a leaf switch according to the present invention using a bracket of an inverted U-shape , FIGS. 3(*a*) and 3(*b*) being a front elevation and a side elevation of the leaf switch prior to pivotal mounting of the bracket on an insulating base.
Figure 3A:
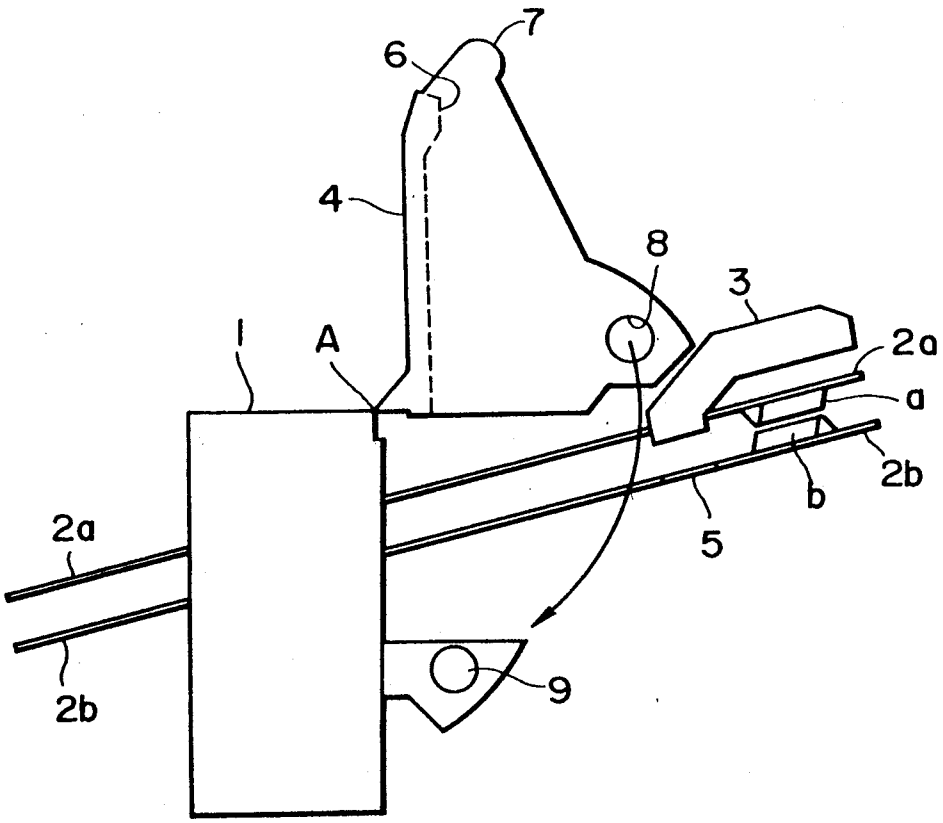
Figure 3C:
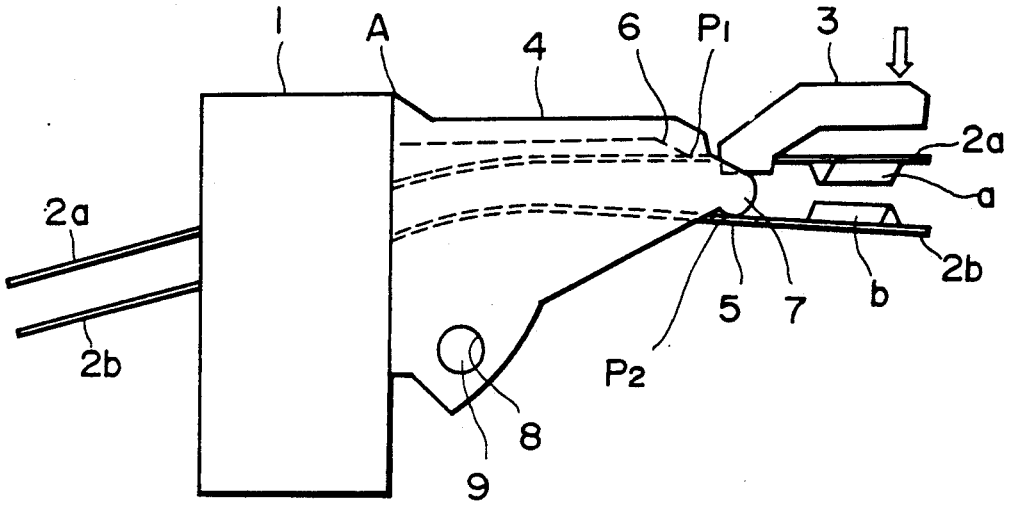

FIGS. 3(*a*) to 3(*c*) show a further embodiment of a leaf switch according to the present invention, in which a bracket 4 of an inverted U-shape is mounted on an upper end of the insulating base 1 so as to be pivotable about a support A. In this case, the contact leaf spring 2*b* is formed with small projections 5 on both sides and the two legs of the U are joined by a top plate and each has a forwardly extending side plate.

Pivotal movement of the bracket 3 about the support A causes the distal end 6 of the top plate of the bracket 4 to strike the leaf spring 2*a* and the distal ends 7 of each of the side plates to strike the projections 5. The contact leaf springs 2*a* and 2*b* are then bent until small holes 8 in the side plates of the bracket 4 locate on toggles 9 provide on the insulating base 1. This joins the bracket 4 to the insulating base 1. Thus, the distal end 6 of the top plate and the distal ends 7 of the side plates serve as the setting points $P_1$ and $P_2$, respectively, resulting in the contact leaf springs 2*a* and 2*b* being kept in a stressed state.

The leaf switch of FIGS. 3(*a*) to 3(*c*) constructed as described above is of the normally-open type. Accordingly, by pressing the operating element 3, the contacts a and b come into contact and the switch is turned on. When the operating element 3 is released, contact between the contacts a and b is broken, resulting in the switch being turned off.

Figure 4A:
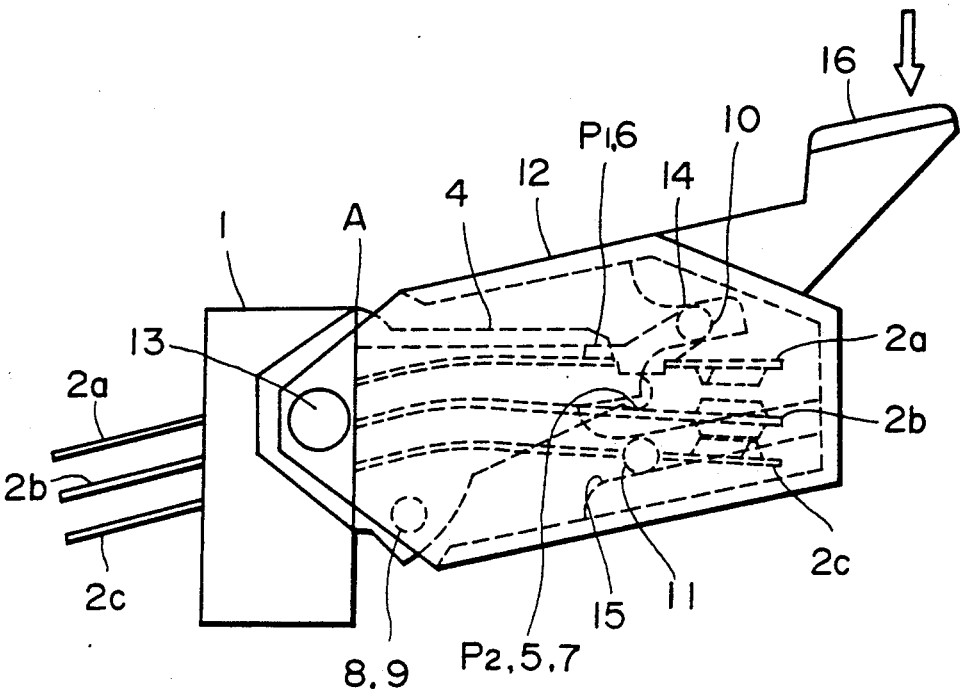
FIGS. 4(*a*) and 4(*b*) are a front elevation view and a bottom view showing another embodiment of a leaf switch according to the present invention, in which a hollow cover is pivotally fitted on an insulating base, FIGS. 5(*a*) and 5(*b*) show the leaf switch of FIG. 4(*a*) to 4(*c*) prior to mounting of the hollow cover on the insulating base, FIG. 5(*a*) being a front elevation of the leaf switch prior to pivotal movement of the bracket and FIG. 5(*b*) being a front elevation of the leaf switch after pivotal mounting of the bracket.
Figure 4B:
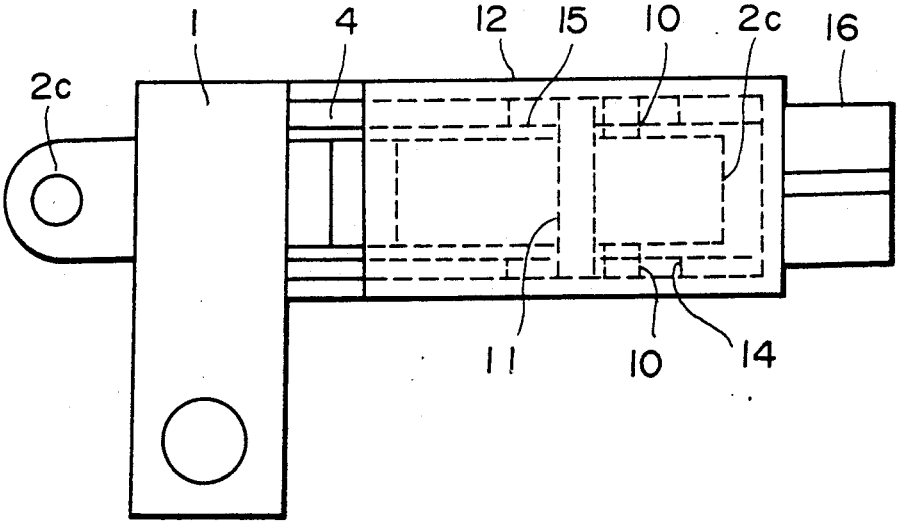
Figure 5:
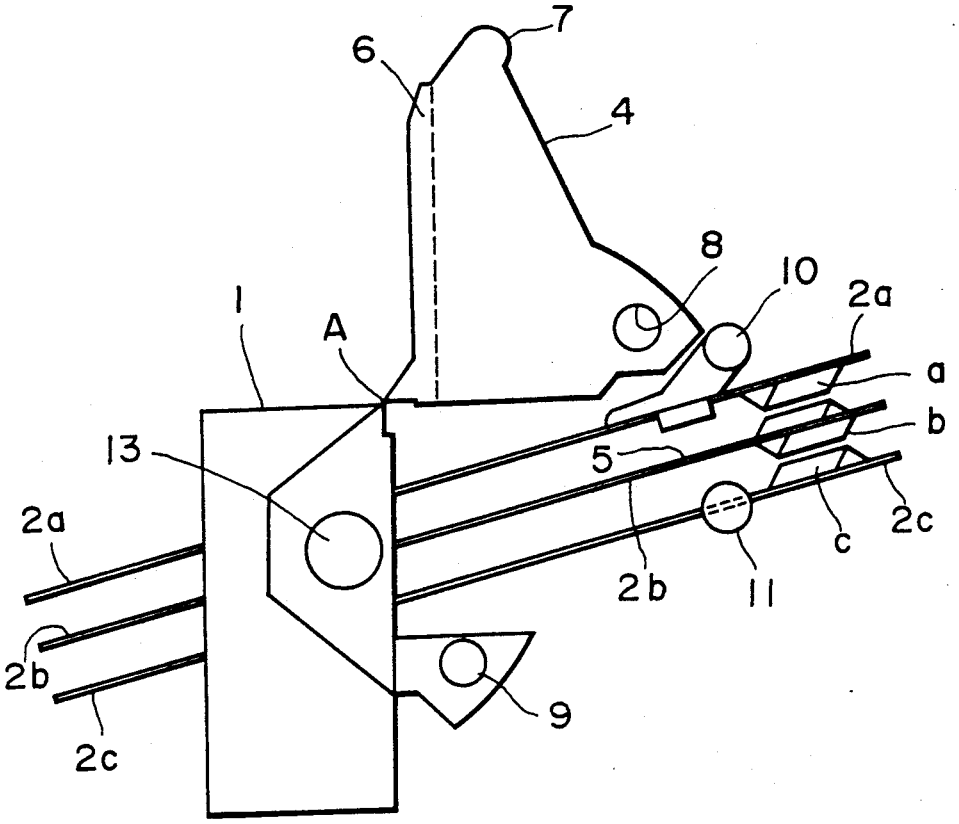
Figure 5:
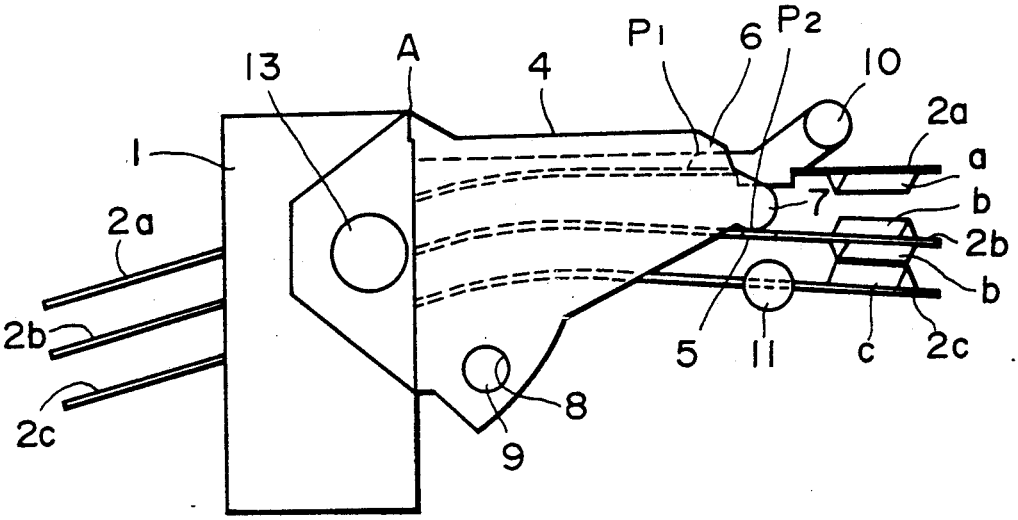
Figure 6A:
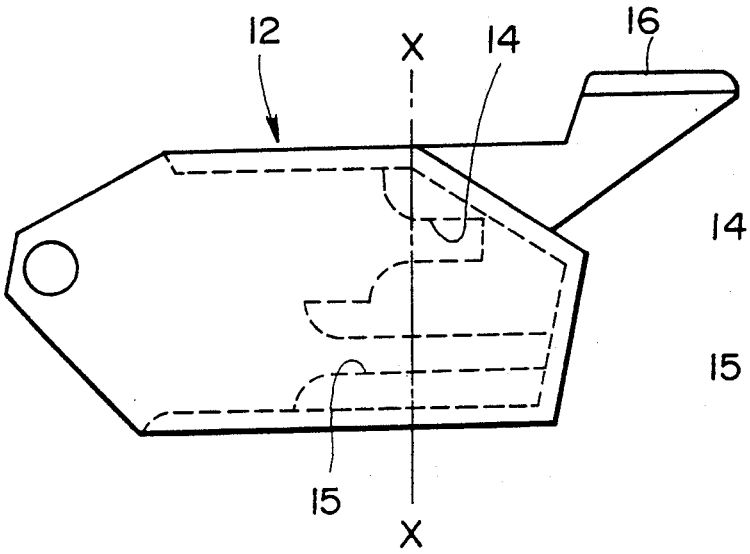
FIGS. 6(*a*), 6(*b*) and 6(*c*) are a detail of the hollow cover, in which FIG. 6(*a*) is an elevation, FIG. 6(*b*) is a plan view and FIG. 6(*c*) is a sectional view taken along the line X—X of FIG. 6(*a*).
Figure 6C:
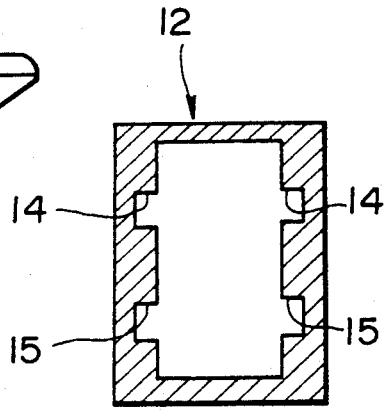
Figure 6B:
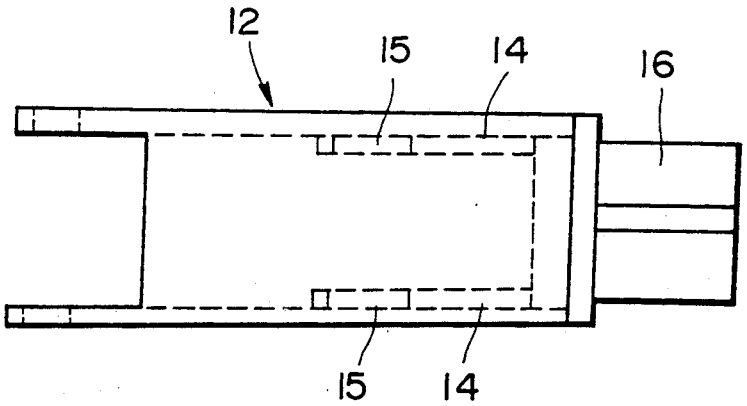

The embodiment shown in FIGS. 4 to 6 takes the form of a leaf switch of the composite type which is a combination of the normally-open type and the normally-closed type and includes three contact leaf springs 2*a*, 2*b* and 2*c*. The leaf switch of the illustrated embodiment is so constructed that when the bracket 4 of inverted U-shape is moved pivotally to its end point, with the holes 8 and toggles 9 in registry, the bracket 4 is joined to the insulating base 1, keeping the contact leaf spring 2*a* in a stressed state at a setting point $P_1$ , and keeping the contact leaf spring 2*b* in a stressed state at a setting point $P_2$. The setting point $P_1$ is defined at the distal end 6 of the top plate by contact between the top plate and an engagement element 10 mounted on the leaf spring 2*a* which is pressed into contact with the top plate. The o setting point $P_2$ is defined at the distal ends 7 of the side plates by contact with the projections 5 on the leaf spring 2b. Keeping the contact leaf spring 2b in a stressed state in this way causes the contact b to be pressed into contact with a further contact c on the leaf spring 2c so that the leaf spring 2c is bent. This results in the contact leaf spring 2c also being kept in a stressed state.

The engagement element 10 is fixed to the contact leaf spring 2a while a corresponding engagement element 11 is fixed to the contact leaf spring 2c.

The illustrated embodiment also includes a hollow cover 12, which is pivotably fitted on the insulating base 1 by means of a shaft 13 in such a way that it covers the contact leaf springs 2a, 2b and 2c and the bracket 4. The hollow cover 12 is formed on its interior with engaging portions 14 and 15 which are arranged to engage the elements 10 and 11 respectively., As described above, the leaf switch of FIGS. 4 to 6 is a composite type which is a combination of the normally-open type and the normally-closed type. It is so constructed that the hollow cover 12 is pivotably mounted on the insulating base 1 in a manner to allow it to cover the contact leaf springs 2a and 2c and the bracket 4.

When an operating section 16 of the hollow cover 12 is pressed to move the cover 12 pivotally, the contact leaf spring 2a is bent as the engaging element 10 of the contact leaf spring 2a is engaged by the engaging portion 14, resulting in contact between the contacts a and b to cause the first switch to be turned on. Simultaneously, the contact leaf spring 2c is bent as the engaging element 11 of the contact leaf spring 2c is engaged by the engaging portion, to separate the contact b from the contact c to cause the second switch to be turned off.

When the hollow cover 12 is released the contact leaf springs 2a and 2c are returned to their original position, causing the hollow cover 12 to be moved pivotally to its original position. This results in causing the first switch to be turned off, and the contacts b and c being brought into contact causing the second switch to be turned on.

What is claimed is:

1. An apparatus usable as a leaf switch comprising a plurality of contact leaf springs embedded in and protruding from an insulating base, the leaf springs extending substantially parallel with one another and each having a contact, the leaf springs each being capable of being forcedly inflected to maintain them in a stressed state by holding at least one leaf spring at a setting point, thereby providing either a predetermined or uniform interval between the contacts on the leaf springs, or a predetermined or uniform pressure for pressured contact between the contacts, whereby the operating power required for contact and/or separation between contacts is rendered uniform, further including a setting member hinged via a pivotal connection on the base and positionable at a first position in which it inflects the leaf springs into their stressed states to form a leaf switch and a second position in which it is mounted to the base but does not substantially inflect the leaf springs.

2. An apparatus as claimed in claim 1 in which the setting member is a bracket of an inverted U-shape pivotally mounted on the base and including a top plate and two side plates, the bracket inflecting the contact leaf springs when it is pivotally moved and being coupled to the base when it is pivotally moved to its first position.

3. An apparatus as claimed in claim 2 in which the distal ends of the top plate and side plates of the bracket define setting points for the contact leaf springs when the bracket is moved to its first position, resulting in each contact leaf spring being held in a stressed state at its own setting point.

4. An apparatus as claimed in any of claims 1 or 2, of the normally-closed type including two leaf springs, one of the leaf springs being held at a setting point and bending the other leaf spring whereby, in this condition, both leaf springs are in a stressed state.

5. An apparatus, as claimed in any of claims 1 or 2 of the normally-open type including two leaf springs each of which is engaged by the setting member in its first position to hold both leaf springs at a setting point and in a stressed state.

6. An apparatus as claimed in any of claims 1 or 2 of the composite type including three leaf springs, two being normally closed and two being normally open, the two normally open leaf springs each being engaged by the setting member in its first position to hold each at a setting point, the third leaf spring being bent by one of the normally open leaf springs whereby all three leaf springs are in a stressed state.

7. An apparatus as claimed in any of claims 1 or 2 further comprising a hollow cover pivotally mounted on the insulating base in a manner to cover the contact leaf springs and the setting member.

8. An apparatus as claimed in claim 7 in which the hollow cover is provided on its inner surface with engaging portions which are arranged to engage engaging portions on the leaf springs.

* * * * *